United States Patent [19]

Santo

[11] 4,224,705

[45] Sep. 30, 1980

[54] ADJUSTABLE WATERBED MATTRESS SUPPORT

[76] Inventor: Philip J. Santo, 100 Fernwood Ave., Rochester, N.Y. 14621

[21] Appl. No.: 936,761

[22] Filed: Aug. 25, 1978

[51] Int. Cl.[2] ..... A47C 27/08

[52] U.S. Cl. ..... 5/400; 5/186 R; 5/451; 5/202

[58] Field of Search ..... 5/91, 182–191, 5/200–202, 400, 446, 451, 458; 297/442; 108/51.3

[56] References Cited

U.S. PATENT DOCUMENTS

| | | | |
|---|---|---|---|
| 317,922 | 5/1885 | Bulkeley et al. | 5/202 |
| 630,140 | 8/1899 | Varcoe | 5/182 |
| 3,604,751 | 9/1971 | Caigon | 297/442 |
| 3,761,974 | 10/1973 | Kuss | 5/401 |
| 3,995,334 | 12/1976 | Harris | 5/202 |
| 3,999,231 | 12/1976 | Robins | 5/202 |
| 4,125,912 | 11/1978 | Courter | 5/400 |

*Primary Examiner*—Casmir A. Nunberg
*Attorney, Agent, or Firm*—Lawrence P. Kessler

[57] ABSTRACT

An adjustable support for accommodating waterbed mattresses of a variety of sizes. The adjustable support comprises a pair of spaced apart upstanding side rails interconnected by an accordion type collapsible construction which enables the side rails to be variably positioned a desired distance apart depending upon the size of the mattress to be supported. The interconnecting construction which serves as the structural support for the mattress, is assembled to be collapsible in the non-loadbearing direction such that the spacing between the side rails may be varied.

4 Claims, 5 Drawing Figures

ADJUSTABLE WATERBED MATTRESS SUPPORT

BACKGROUND OF THE INVENTION

1. Field of the Invention

This invention relates generally to waterbed mattress supports, and more particularly to an adjustable support for accommodating waterbed mattresses of any of a variety of sizes.

2. Description of the Prior Art

It is an accepted general practice to support waterbed mattresses on a platform which is, in turn, supported on a pedestal. The pedestal is assembled from a series of upstanding parallel rigid members interconnected by parallel rigid cross-members to form an open celled, box-like construction. When the platform is placed on the pedestal, a support foundation is established for the waterbed mattresses which distributes the weight of the mattresses over a larger area than would be the case with conventional type bedding perimeter support frames. The distribution of the weight of the waterbed mattress over a larger area is, of course, necessary since the typical waterbed mattress is considerably heavier than conventional stuffed or box-spring mattresses and could develop undue stress loads in any limited area support.

Like conventional mattresses, waterbed mattresses are customarily available in a variety of sizes. Because of the above described manner in which waterbed mattress support pedestals have previously been constructed, each mattress size has a pedestal of a particular size designed for use therewith. The respective different size pedestals are not interchangeable because of the nature of the particular configuration of each pedestal required to support a different size mattress. That is to say, the pedestal support for a waterbed mattress of a small size (e.g., commonly referred to as twin-size) would be too small for adequately supporting a larger size mattress (e.g., commonly referred to as king-size). Conversely, the pedestal for supporting the larger mattress would extend beyond the sides of the smaller mattress.

With conventional type bedding, the perimeter support frames can be adjustable as, for example, with expandable side or end rails as shown in U.S. Pat. No. 317,922 issued May 12, 1885 in the name of Bulkeley et al, or U.S. Pat. No. 2,768,391 issued Oct. 30, 1956 in the name of Shapiro. Adjustable supports for waterbed mattresses have, however, proven impractical because of the particular support required for proper distribution of the weight of the mattress. As described immediately above, such support has heretofore been provided by the particularly configured and non-interchangeable pedestals.

SUMMARY OF THE INVENTION

Accordingly, it is a purpose of this invention to provide an adjustable support for accommodating waterbed mattresses of a variety of sizes. The adjustable support comprises a pair of spaced apart upstanding side rails adjustably interconnected by load bearing members, which for example are of an accordion-type collapsible construction in the non-load bearing direction. Thus, the load bearing members enable side rails to be positioned a desired distance apart depending upon the size of the mattress to be supported, while the load bearing members serve as the structural support for any such mattress.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
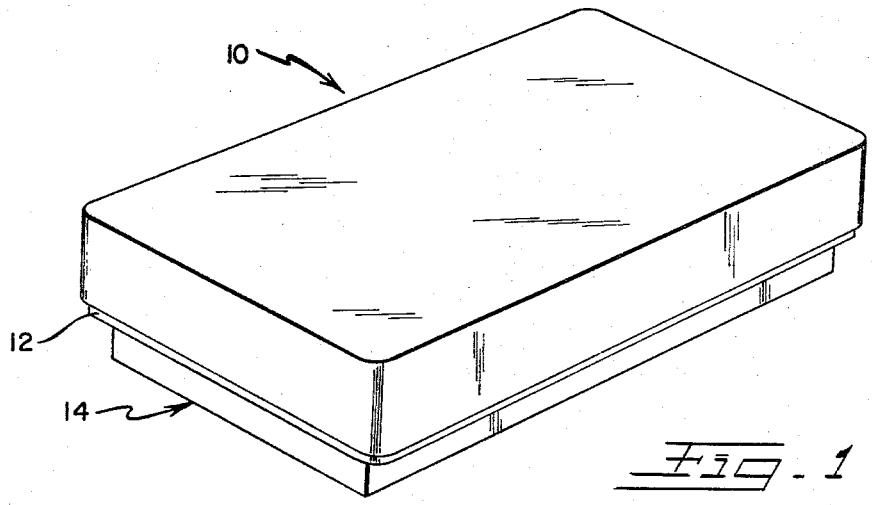
FIG. 1 is a view, in perspective, of a waterbed mattress mounted on the adjustable support according to this invention.

Referring now to the drawings, a waterbed mattress 10 is shown in FIG. 1 carried on a platform 12 mounted by the adjustable support 14 of this invention. The mattress 10, which may be of any well known construction, typically is a flexible-walled bladder filled with a fluid, such as water. As with conventional mattresses, the waterbed mattress may be of a variety of sizes (e.g., commonly called twin, double, or king-size). While the length of each size mattress may be substantially the same, the width thereof varies to an extent which precludes support of the various mattresses by a single-size support. Accordingly, the support 14 is constructed to be adjustable in the manner described below, such that the support can accommodate any of the variety of mattress sizes.

Figure 2:
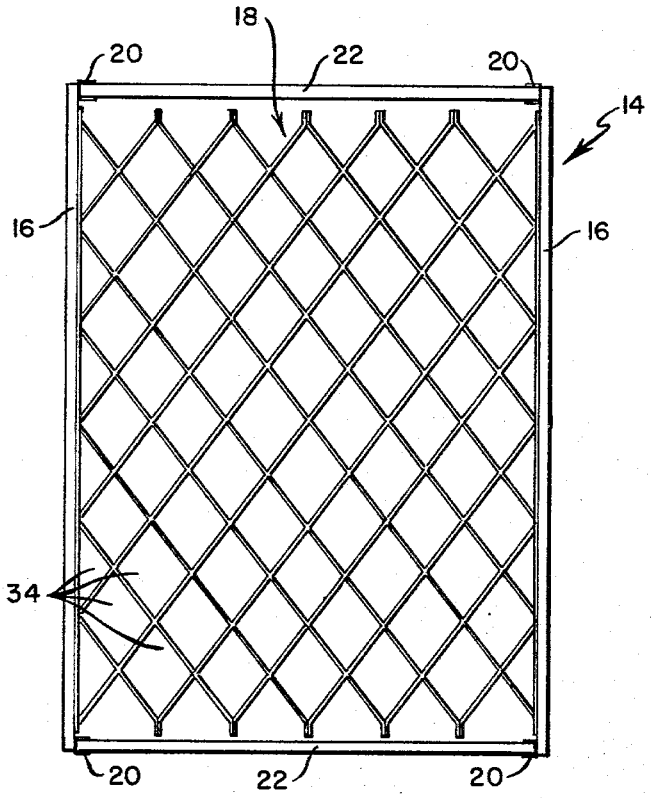
FIGS. 2 and 3 are top plan views of the adjustable support with the side rails respectively located to accommodate mattresses of different sizes.
Figure 3:
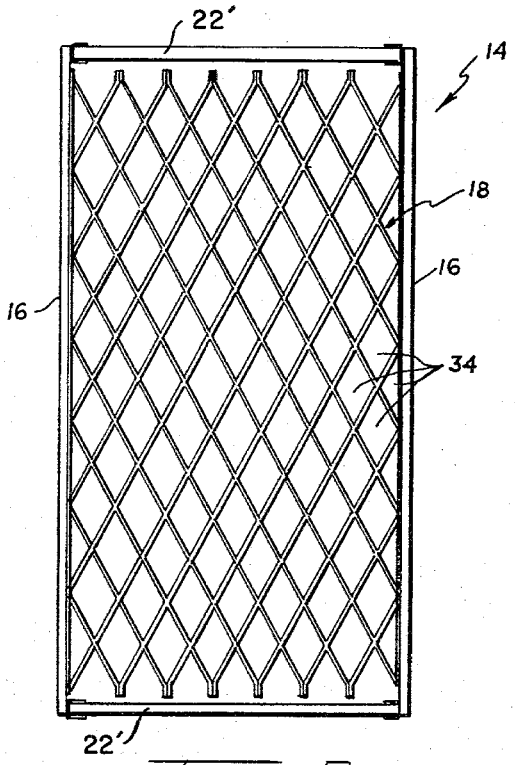

The adjustable support 14 comprises a pair of side rails 16 upstanding along a respective marginal edges. The side rails 16 are interconnected by an accordion-type collapsible construction 18 which enables the side rails 16 to be variably positioned a desired distance apart (see FIGS. 2 and 3) depending upon the size of the mattress to be supported. The side rails 16 are formed of a rigid material, such as wood, and have oppositely disposed vertical channels 20 located at the ends of each rail. The channels 20 slidably receive upstanding end rails 22. The length of the end rails 22 is selected, depending upon the width of the mattress to be supported so as to space the side rails a desired distance apart. The spatial distance between the side rails is selected to enable the support 14 to provide an adequate base for the mattress for proper distribution of the weight of the mattress.

Figure 4:
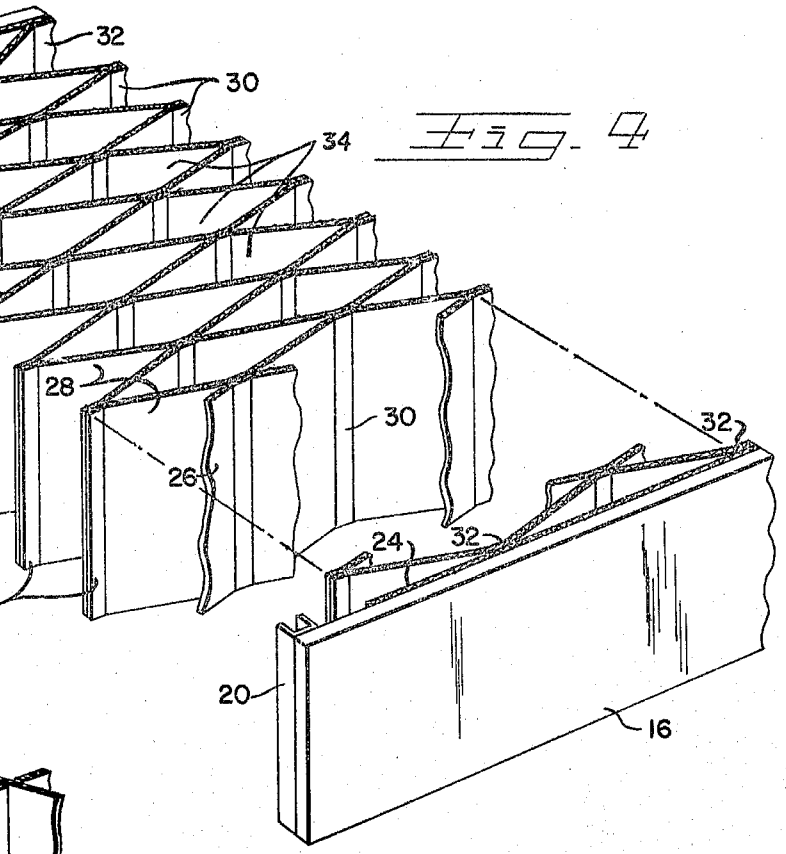
FIG. 4 is a view, in perspective, of a portion of the adjustable support of this invention, particularly showing the load bearing interconnecting members.

The accordion-type collapsible construction 18, in the embodiment of FIG. 4, includes elongated outboard members 24 fixed to the opposing faces of the side rails 16, such as by gluing or any other suitable fastening means. Between the outboard members 24 are elongated substantially serpentine members 26 and oppositely oriented elongated substantially serpentine members 28 spaced from said members 26 and upstanding along respective marginal edges. The arrangement of the serpentine members 26 and 28 in opposite orientations results in the members having spaced contact points 30, and contact points 32 with the outboard members 24. The members 26 and 28 are joined together at the contact points 30 and to the outboard members 24 at the contact points 32, such as by gluing or any other suitable fastening means. With the members so joined, a honeycomb arrangement established with collapsible cells 34. The members 24, 26 and 28 are formed of a material that has substantial beam strength in a direction transverse of the members whereby the members are load bearing, in that direction, for structural support of the mattress. An example of such material is wax impregnated paper board. The spacing between the side rails 16 can thus be varied in the non-loadbearing direction while the collapsible construction 18 retains its capability for structural support of the mattress.

Figure 5:
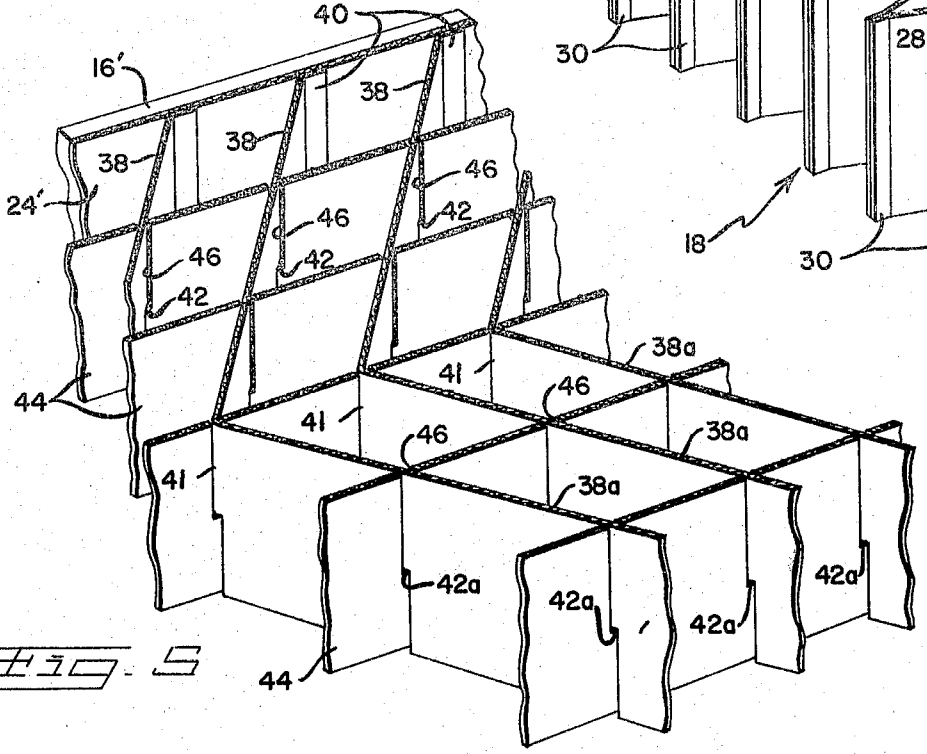
FIG. 5 is a view, in perspective, similar to FIG. 4 showing an alternate construction of the load bearing interconnecting members.

In the modified embodiment of the accordion-type collapsible construction 18 shown in FIG. 5, elongated members 24' are fixed to the opposing faces of the side rails 16', such as by gluing or any other suitable fastening means. A series of elongated members 38 supstanding along respective marginal edges are connected, such as by gluing or other suitable fastening means, to the side rails 16' by hinge sections 40. The hinge sections 40 enable the intersecting angle of the members 38 with respect to the side rails 16' to be varied. Additional series of elongated upstanding members 38*a* (etc.) are connected at hinge points 41 to the members 38 respectively at an angle there to form a Z shaped construction between the side rails 16'. The Z shaped construction enables the spacing between the side rails to be varied while the side rails maintain there relative longitudinal relationship. The members 38 (38*a*) have a series of notches 42 (42*a*, etc.) equidistantly spaced therealong and extending vertically from the bottom of the members approximately one-half of the member height. A series of elongated members 44 upstanding along respective marginal edges are internested with the members 38 (38*a*, etc.) to provide structural rigidity thereto. The members 44 have respective series of notches 46 equidistantly spaced therealong and extending vertically from the top of the members approximately one-half of the member height. When the members 44 are internested with the members 38 (38*a*, etc.) by interengagement of the notches 42 and 46, the members 44 and 38 form a collapsible egg crate construction such that the members 44 are always oriented parallel to the side rails 16' at any relative spacing between the side rails. The members 38 (38*a*, etc.) and 44 are formed of a material having substantial transverse beam strength, such as that described for members 24, 26, and 28 in the above embodiment. In this manner, the spacing between the side rails 16' can be varied by collapsing of the Z shaped members 38 (38*a*, etc.) while load bearing support of the mattress is provided and structural rigidity of the overall construction 18 is maintained by the members 44.

I claim:

1. Adjustable waterbed mattress support for accomodating a waterbed mattress of any of a variety of sizes, said adjustable support comprising:

a pair of spaced apart side rails upstanding along respective marginal edges thereof; and accordion-type load bearing means, collapsible in the non-load bearing direction, for adjustably interconnecting said side rails, said load bearing means including a first series of elongated substantially serpentine members upstanding along respective marginal edges thereof, a second series of elongated substantially serpentine members upstanding along respective marginal edges thereof, said second series of members being oriented relative to said first series of members to have spaced contact points therewith and to be collapsible toward one another between said contact points, means for connecting said first series of members to said second series of members at said contact points, and means for connecting the outboard most member of said first and second series of members to said side rails, whereby said side rails may be positioned a desired distance apart, depending upon the size of such mattress to be supported while any such mattress is supported by said first and second series of members.

2. The invention of claim 1 wherein said first and second series of elongated members are formed of wax impregnated paper board.

3. Adjustable waterbed mattress support for accomodating a waterbed mattress of any of a variety of sizes, said adjustable support comprising:

a pair of spaced apart side rails upstanding along respective marginal edges thereof; and accordion-type load bearing means, collapsible in the non-load bearing direction, for adjustably interconnecting said side rails, said load bearing means including a series of collapsible elongated Z-shaped members upstanding along respective marginal edges thereof and connected at their respective ends to said side rails, a series of substantially straight elongated members upstanding along respective marginal edges thereof, said series of straight members interconnecting respective apexes of said series of Z-shaped members to form a collapsible egg-crate construction, whereby said side rails may be positioned a desired distance apart, depending upon the size of such mattress to be supported while any such mattress is supported by said Z-shaped and straight elongated series of members.

4. The invention of claim 3 wherein said first and second series of elongated members are formed of wax impregnated paper board.

* * * * *